US007665838B2

(12) United States Patent
Ogimura et al.

(10) Patent No.: US 7,665,838 B2
(45) Date of Patent: Feb. 23, 2010

(54) RECORDING APPARATUS

(75) Inventors: Takafumi Ogimura, Shiojiri (JP); Sumito Anzai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 137 days.

(21) Appl. No.: 12/055,144

(22) Filed: Mar. 25, 2008

(65) Prior Publication Data

US 2008/0238976 A1 Oct. 2, 2008

(30) Foreign Application Priority Data

Mar. 26, 2007 (JP) ..... 2007-079602

(51) Int. Cl.
*B41J 2/01* (2006.01)

(52) U.S. Cl. ..... 347/104; 347/101; 347/16

(58) Field of Classification Search ..... 347/104, 347/16

See application file for complete search history.

(56) References Cited

U.S. PATENT DOCUMENTS

2006/0024118 A1* 2/2006 Niikura et al. ..... 400/691

2006/0285858 A1* 12/2006 Shin ..... 399/16

FOREIGN PATENT DOCUMENTS

JP 2003-026349 1/2003
JP 2005-200141 7/2005

* cited by examiner

*Primary Examiner*—Matthew Luu
*Assistant Examiner*—Brian J Goldberg
(74) *Attorney, Agent, or Firm*—Workman Nydegger

(57) ABSTRACT

A recording apparatus is provided including: a recording medium setting portion on which a plural recording media are set in a stacked state; a feed roller that feeds a recording medium set on the recording medium setting portion in a feeding direction; a recording medium return lever that returns a recording medium next or subsequent to a recording medium continuously fed out from the recording medium setting portion along with the recording medium to be fed; a control unit that controls the recording medium return lever; and a recording unit that performs recording on the recording medium, wherein the control unit controls the recording medium return lever so that the position is switched from a first position, a second position and to a third position.

10 Claims, 7 Drawing Sheets

RETURN LEVER IN FIRST SWITCH MODE
CR MOTOR
PF MOTOR
ASF MOTOR
ASF SUB-MOTOR
ON
OFF
FINAL MAIN SCAN
FINAL SHEET CONVEY
SHEET DISCHARGE
NEXT PAGE FEEDING
Pos SWITCHING
Pos. 3→1
Pos. 1→2
c
d

RETURN LEVER IN SECOND SWITCH MODE
a
b

RETURN LEVER IN FIRST SWITCH MODE

RETURN LEVER IN SECOND SWITCH MODE

RECORDING APPARATUS

BACKGROUND

1. Technical Field

The present invention relates to a recording apparatus that performs a recording on a recording medium.

2. Related Art

In ink jet printers, which is an example of a recording apparatus or a liquid ejecting apparatus, a feeding unit (also known as ASF: Auto Sheet Feeder) capable of storing plural sheets as a recording medium is installed. The feeding unit includes a feed roller that rotates in contact with a sheet to feed the sheet to the downstream side, a hopper that supports the sheet and switches its posture between a posture wherein the sheet comes into pressure contact with the feed roller and a posture wherein the sheet is separated from the feed roller, and a return lever that returns a sheet, which might cause a multiple feeding, to an upstream side. In the feeding unit, the uppermost one of the plural sheets is fed out on an one-by-one basis.

The return lever can switch its position between a first position wherein it close a sheet feeding path and a second position wherein it opens the sheet feeding path. In addition to the two positions, the return lever may switch between three positions (see, JP-A-2003-26349, for example). The third position is positioned at a position closer to the upstream side than the first position. In JP-A-2003-26349, the purpose of providing the third position is to pivot the return lever toward the upstream side before the feeding operation is started. With this, a bundle of sheet can be returned to a proper position on the hopper before the feeding operation is started. Therefore, in a feeding waiting state, the uppermost sheet does not come into contact with the feed roller, thereby preventing a multiple feeding.

The provision of the third position can optimize the posture of sheet during a recording operation. That is, in the first position, the return lever advances closest to the sheet feeding path to close the sheet feeding path. When a recording is performed on the sheet in such a position, the rear end of the sheet may be greatly curved and a large back tension is applied thereto, thereby deteriorating the recording quality. Scratches may be caused to the rear surface of the sheet. Therefore, during recording on the sheet, by switching the return lever to the third position so that the leading end moves away from the sheet feeding path and returning the return lever to the first position after the preceding page is discharged, such a problem can be solved.

There is an increasing demand for improving the throughput of an apparatus. However, when the third position is provided to the return lever, the additional return operation from the third position to the first position may delay the feeding operation of the subsequent page. Consequently, it is difficult to improve the throughput.

SUMMARY

An advantage of some aspects of the invention is that it provides a recording apparatus which can efficiently perform a return operation of a return lever from a third position to a first position, thereby improving the throughput much more.

According to a first aspect of the invention, there is provided a recording apparatus, including: a recording medium setting portion on which plural recording media are set in a stacked state; a feed roller that feeds a recording medium set on the recording medium setting portion in a feeding direction; a recording medium return lever that returns a recording medium next or subsequent to a recording medium continuously fed out from the recording medium setting portion along with the recording medium to be fed; a control unit that controls the recording medium return lever; and a recording unit that performs recording on the recording medium, wherein the control unit controls the recording medium return lever so that the position is switched from a first position, a second position and to a third position: in the first position, the recording medium return lever is in a feeding waiting state and closes the sheet feeding path; in the second position, a leading end of the recording medium return lever is positioned at a position positioned closer to a downstream side than the first position; and in the third position, the leading end is positioned at a position positioned closer to an upstream side than the first position, and wherein the control unit has a control mode in which when a feeding operation of a subsequent page is about to start, a partial or entire portion of a return operation of the recording medium return lever from the third position to the first position is performed in parallel with an operation performed in relation with a preceding page.

According to the first aspect of the invention, the control unit of the recording apparatus has a control mode in which when a feeding operation of a subsequent page is about to start, a partial or entire portion of a return operation of the recording medium return lever from the third position to the first position is performed in parallel with an operation performed in relation with a preceding page. When this control mode is performed, most or all of the return operation of the recording medium return lever may be completed before the feeding operation of the subsequent page is started. Therefore, when performing the feeding operation of the subsequent page, it is not necessary to wait until the return operation of the recording medium return lever is completed, thus decreasing or obviating the waiting period, and improving the throughput much more.

Here, "operation performed in relation with a preceding page" refers to the feeding operation, recording operation, discharge operation or the like of the preceding page. That is, it means all the operations performed in relation to the preceding page after the recording medium return lever is completely switched to the third position until the discharge operation of the preceding page is completed.

According to a second aspect of the invention, there is provided a recording apparatus, including: a recording medium setting portion on which a plural recording media are set in a stacked state; a feed roller that feeds a recording medium set on the recording medium setting portion in a feeding direction; a recording medium return lever that returns a recording medium next or subsequent to a recording medium continuously fed out from the recording medium setting portion along with the recording medium to be fed; a control unit that controls the recording medium return lever; and a recording unit that performs recording on the recording medium, wherein the control unit controls the recording medium return lever so that the position is switched from a first position, a second position and to a third position: in the first position, the recording medium return lever is in a feeding waiting state and closes the sheet feeding path; in the second position, a leading end of the recording medium return lever is positioned at a position positioned closer to a downstream side than the first position; and in the third position, the leading end is positioned at a position positioned closer to an upstream side than the first position, and wherein the control unit has a control mode in which when a feeding operation of a subsequent page is about to start, a return operation of the recording medium return lever from the third position to the first position is completed before the feeding operation of the subsequent page becomes ready to start.

According to the second aspect of the invention, the control unit of the recording apparatus has a control mode in which when a feeding operation of a subsequent page is about to start, a return operation of the recording medium return lever from the third position to the first position is completed before the feeding operation of the subsequent page becomes ready to start. Like the first aspect, when this control mode is performed, all of the return operation of the recording medium return lever may be completed before the feeding operation of the subsequent page is started. Therefore, when performing the feeding operation of the subsequent page, it is not necessary to wait until the return operation of the recording medium return lever is completed, thus obviating the waiting period, and improving the throughput much more.

A third aspect of the invention is the recording apparatus according to the first or second aspect, in which in the control mode, the control unit starts the return operation of the recording medium return lever from the third position to the first position after the final sub-scanning conveying for recording on a preceding page is completed.

According to the third aspect, in the control mode, the control unit starts the return operation of the recording medium return lever from the third position to the first position after the final sub-scanning conveying for recording on a preceding page is completed. Since the recording medium return lever returns to the first position, a back tension may be caused to the recording medium. However, since the sub-scanning conveying for recording on the preceding page is already completed before the return operation to the first position is started, it is possible to perform the recording without deteriorating the recording quality, which may otherwise be found when the sub-scanning precision deteriorates.

A fourth aspect of the invention is the recording apparatus according to any one of the first to third aspects, in which depending on the type of the recording medium, the control unit starts the return operation of the recording medium return lever from the third position to the first position when the rear end of the recording medium has advanced to a position positioned closer to the downstream side than a position where the rear end comes into the recording medium return lever.

For example, when the recording medium is a specific sheet having a coating layer, which has a high rigidity, and when the recording medium enters into a state in which the recording medium is raised by the recording medium return lever at the first position, a large back tension may be generated. According to the fourth aspect, depending on the type of the recording medium, the control unit starts the return operation of the recording medium return lever from the third position to the first position when the rear end of the recording medium has advanced to a position positioned closer to the downstream side than a position where the rear end comes into the recording medium return lever. Therefore, it can be prevented that the recording medium enters into a state in which the recording medium is raised by the recording medium return lever at the first position. Therefore, it is possible to perform the recording without causing a large back tension and applying damage to the rear surface of the recording medium.

A fifth aspect of the invention is the recording apparatus according to any one of the first to third aspects, in which the recording apparatus includes a reversing unit that reverses the recording medium having data recorded thereon, wherein when a duplex recording is performed on the recording medium and when the return operation of the recording medium return lever from the third position to the first position is performed before a recording is performed on the second surface of the recording medium, the control unit starts the return operation when the rear end of the recording medium has advanced to a position positioned closer to the downstream side than a position where the rear end comes into contact with the recording medium return lever.

When a recording is performed on both surfaces of the recording medium, scratches on a surface (second surface) opposite a surface (first surface), on which the recording is performed first, may deteriorate the recording quality of the second surface. According to the fifth aspect, when a duplex recording is performed on the recording medium, the control unit starts the return operation of the recording medium return lever when the rear end of the recording medium has advanced to a position positioned closer to the downstream side than a position where the rear end comes into contact with the recording medium return lever. Therefore, the second surface of the recording medium does not come into contact with the recording medium return lever at the first position. Accordingly, it is possible to prevent generation of a large back tension and scratches on the second surface of the recording medium. Therefore, it is possible to perform the recording without deteriorating the recording quality of the second surface.

A sixth aspect of the invention is the recording apparatus according to any one of the first to third aspects, in which depending on a recording mode in which a recording is performed on the recording medium, the control unit starts the return operation of the recording medium return lever from the third position to the first position when the rear end of the recording medium has advanced to a position positioned closer to the downstream side than a position where the rear end comes into the recording medium return lever.

As a mode related to a recording when performing a recording on a recording medium, there are plural modes based on the level of image quality, such as "high-quality" mode (recording-quality priority mode) or "fast" mode (throughput priority mode). According to the sixth aspect, depending on a recording mode in which a recording is performed on the recording medium, the control unit starts the return operation of the recording medium return lever when the rear end of the recording medium has advanced to a position positioned closer to the downstream side than a position where the rear end comes into the recording medium return lever. In a mode in which a recording quality is prioritized, it is possible to prevent the recording medium from entering into a state in which the recording medium is raised by the recording medium return lever at the first position. Therefore, it is possible to perform the recording without deteriorating the recording quality and causing a large back tension.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a recording apparatus and a liquid ejecting apparatus according to the invention will be described with reference to the accompanying drawings.

Overall Configuration of Ink Jet Printer

Figure 1:
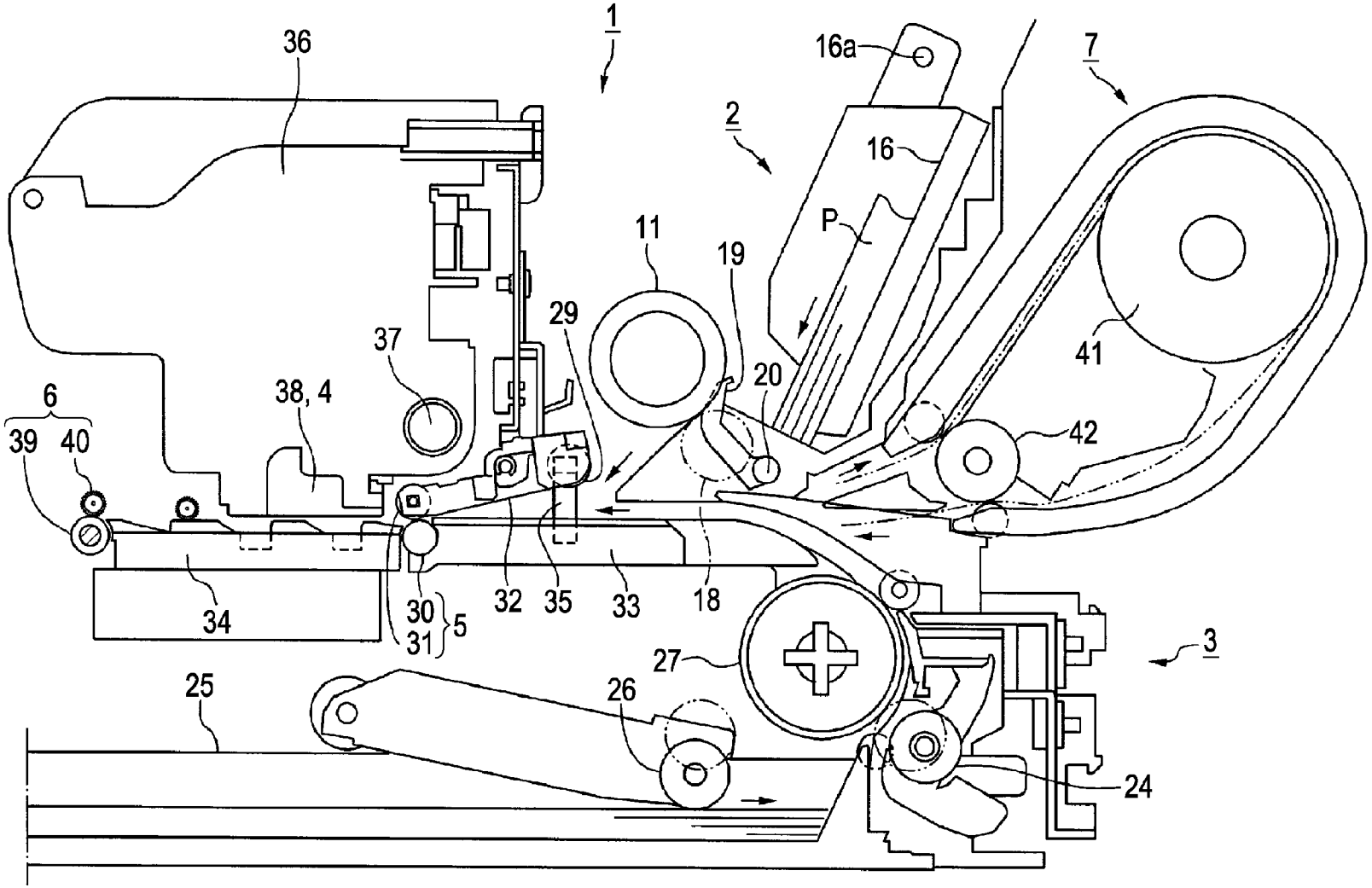
FIG. 1 is a sectional side view of a printer according to the present invention.
Figure 2:
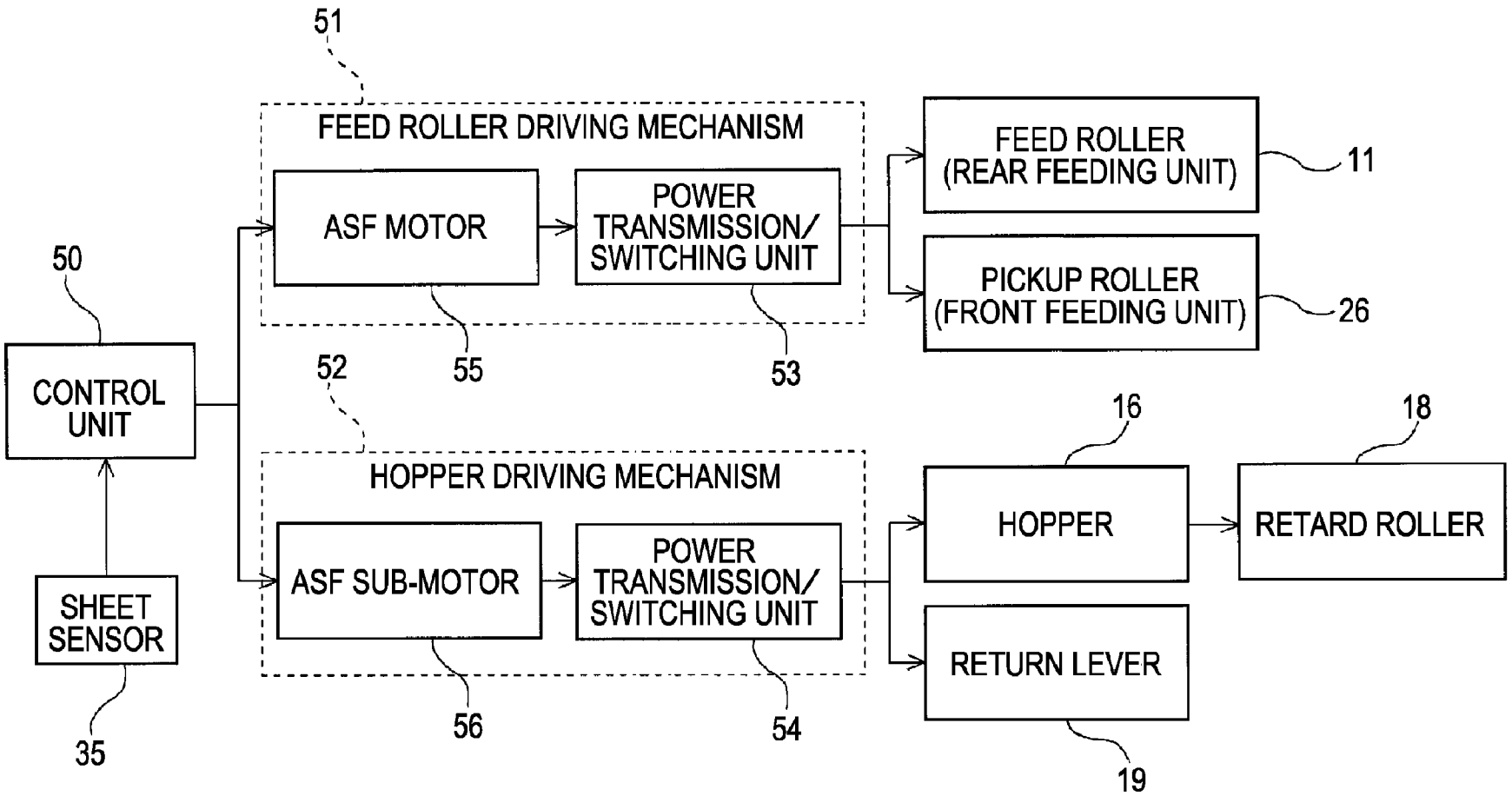
FIG. 2 is a block diagram showing a relationship between a driving source and a driven subject of a rear feeding unit.
Figure 3:
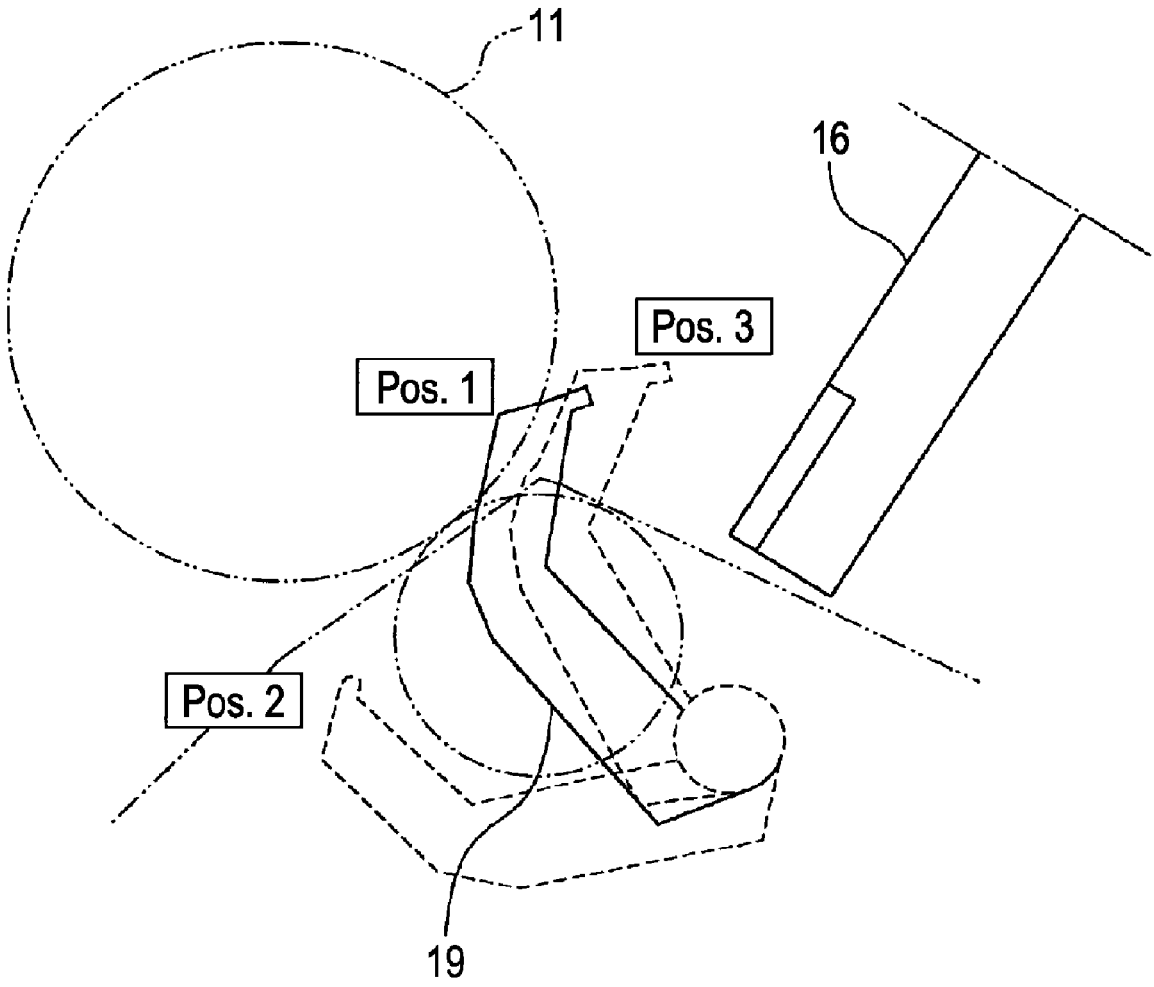
FIG. 3 is an explanatory diagram showing the respective positions of the return lever.

First, an overall configuration of an ink jet printer (hereinafter referred to as a "printer") as an embodiment of a recording apparatus and a liquid ejecting apparatus will be described with reference to FIGS. 1 to 3. FIG. 1 is a schematic side sectional view of a printer 1. FIG. 2 is a block diagram showing a relationship between a driving source and a driven subject of a rear feeding unit 2. FIG. 3 is an explanatory diagram showing the positions of a return lever 19.

The printer 1 is provided with a rear feeding unit 2 at the rear portion thereof and a front feeding unit 3 at the front portion thereof. From the two feeding units, a recording sheet (hereinafter, referred to as a "sheet P") which is an example of a recording medium or ejecting medium, is fed to a transport device 5. The sheet P is transported by the transport device 5 in a sub-scanning direction to a position opposing a recording head 38, and a recording is performed on the sheet P. Thereafter, the sheet P is discharged toward a stacker (not shown) by a sheet discharging device 6. A reversing unit 7 is provided at the rear portion of the rear feeding unit 2. The reversing unit 7 reverses the sheet P so that a recording is performed on a second surface opposite a first surface on which a recording is previously performed. With this, the recording is performed on both surfaces of the sheet P.

Next, components disposed on a sheet transport path will be described in detail.

In FIG. 1, the rear feeding unit 2 includes, as components on a sheet feeding path, a hopper 16, a feed roller 11, a retard roller 18, and a return lever 19.

The hopper 16 constitutes a sheet setting portion on which plural sheets P are set in a staked state. The hopper 16 is provided pivotable about a pivot point 16*a* at an upper portion. When the hopper 16 pivots, it switches its posture between a first posture and a second posture. In the first posture, the sheet P supported on the hopper 16 comes into pressure contact with the feed roller 11; this posture will be referred to as "rising posture." In the second posture, the sheet P is separated from the feed roller 11; this posture will be referred to as "falling posture." The posture switching operation of the hopper 16 is realized by a hopper driving mechanism 52 described later.

The feed roller 11 is circular and the outer periphery is formed of a high friction material. The feed roller 11 rotates in contact with the uppermost sheet P raised by the hopper 16 and feeds the uppermost sheet P toward the downstream side. The feed roller 11 is driven by a feed roller driving mechanism 51 described later.

A retard roller 18 as a separation member has the outer periphery formed of a high friction material and is disposed opposite the feed roller 11 so as to move toward and away from the feed roller 11. The retard roller 18 is applied with a predetermined rotational resistance by a torque limiter device. Therefore, when only the uppermost sheet P is present between the retard roller 18 and the feed roller 11, the retard roller 18 is driven to rotate. On the other hand, when the next or subsequent sheet P is also present between the retard roller 18 and the feed roller 11, the retard roller 18 is not driven and stops by the slipping between sheets. With this, a multiple feeding of the next or subsequent sheet P is prevented. The movement of the retard roller 18 with respect to the feed roller 11 is realized by a hopper driving mechanism 52 described later.

Plural return levers 19 are arranged at predetermined intervals in the axial direction of a pivot shaft 20 that extends in the sheet width direction. With the rotation of the pivot shaft 20, the return levers 19 is pivoted as seen from a side of the sheet transport path. The return lever 19 is driven by a hopper driving mechanism 52 (FIG. 2).

As shown in FIG. 3, the return lever 19 switches its position from a first position to a third position with a second intermediate position; in the drawing and sometimes in this specification, referred to as Pos. 1, Pos. 2, and Pos. 3, respectively. In the first position, the return lever 19 in a feeding waiting state and the leading end advances closest to the sheet feeding path. In the second position, the return lever 19 pivots from the first position so that the leading end opposes the downstream side to open the sheet feeding path. In the third position, the return lever 19 pivots toward the upstream side from the second position so that the leading end is located closer to the upstream side than the position of the leading end when the return lever 19 is at the first position, whereby the posture the rear end of the sheet under recording is regulated. Such a switching operation of the return lever 19 is controlled by a control unit 50 (FIG. 2).

The return lever 19 is pivotable in such a manner that a nip point between the feed roller 11 and the retard roller 18 is within a pivot trajectory the leading end draws. In a standby state before the feeding operation is started, the return lever 19 is positioned at the first position and switches to the second position immediately after the feeding operation is started. Once the leading end of the uppermost sheet P to be fed passes through the return lever 19, the return lever 19 switches from the second position to the third position so that the next or subsequent sheet P is returned to the hopper 16 in the course of the switching from the second position to the their position. When the feeding operation is completed, the return lever 19 returns to the first position from the third position.

During the recording on the sheet P, the return lever 19 is basically maintained at the third position. When the return lever 19 is returned to the first position during the recording onto the sheet P, the leading end at the first position advances closest to the sheet feeding path to excessively raise the sheet P, increasing a back tension applied to the sheet. This may deteriorate a recording quality and/or the leading end may scratch the rear surface of the sheet. However, depending on the type of the sheet P, a recording mode, the position of the rear end of the sheet, or whether a duplex printing will be performed or not, in some cases, the return lever 19 should be returned to the first position from the third position during the recording on the sheet P. This will be described later.

Referring to FIG. 1, the front feeding unit 3 is provided on the bottom portion of the printer 1. The front feeding unit 3 is configured such that users set the sheet P in front of the apparatus. The front feeding unit 3 includes a sheet feeder cassette 25, a pickup roller 26, a feed roller 27, and a retard roller 24.

The pickup roller 26 is driven by a feed roller driving mechanism 51 described later. The sheet feeder cassette 25 is detachably attached to the front side of the apparatus. The pickup roller 26 rotates in contact with the uppermost sheet P set on the sheet feeder cassette 25 so that the uppermost sheet P are continuously fed out from the sheet feeder cassette 25. The feed roller 27 is driven by a driving mechanism to curve and reverse the uppermost sheet P continuously fed out from the sheet feeder cassette 25, thereby feeding the reversed sheet P to the transport device 5 via a sheet guide rear 33.

The retard roller 24 is provided at a position opposite the outer peripheral surface of the feed roller 27 so as to move toward and away from the feed roller 27. When the uppermost sheets P are continuously fed out from the sheet feeder cassette 25, the retard roller 24 comes into pressure contact with the feed roller 27 to form a nip point between them. With this, the leading end of the next or subsequent sheet P continuously fed out from the sheet feeder cassette 25 along with the uppermost sheet P to be fed is caught close to the nip point.

A sheet guide rear 33 and a sheet guide above 32 that guide the sheet P being fed to the transport device 5 are provided on the downstream side of the rear feeding unit 2 and the front feeding unit 3. The sheet P fed by the rear feeding unit 2 and the front feeding unit 3 is guided to the transport device 5 by the sheet guide rear 33 and the sheet guide above 32. A reference numeral 29 represents a guide roller that regulates the posture of the sheet P being fed from the rear feeding unit 2.

A sheet sensor (for example, an optical sensor) 35 that detects the passing of the sheet P is provided on the sheet transport path formed by the sheet guide rear 33 and the sheet guide above 32. The control unit 50 of the printer 1 can identify the passing of the leading or rear end of the sheet by the information from the sheet sensor 35.

The transport device 5 includes a transport driving roller 30, which is driven by a motor (not shown), and a transport follower roller, which is driven to rotate in pressure contact with the transport driving roller 30. The transport follower rollers 31 are arranged in the axial direction of the transport driving roller 30 and rotatably supported by the paper guide above 32. The sheet P fed from the rear feeding unit 2 or the front feeding unit 3 is transported by the transport device 5 to the side of the recording device 4 (recording head 38) on the downstream side.

The recording head 38 is provided on the bottom portion of a carriage 36. The carriage 36 is driven by a motor (not shown) so as to reciprocate in the main scanning direction (a direction of penetrating the sheet in FIG. 1) while being guided by a carriage guide shaft 37 that extends in the main scanning direction. Also, the carriage 36 has mounted thereon independent ink cartridges (not shown) for each of a plurality of colors, and ink is supplied from the ink cartridges to the recording head 38. A sheet guide front 34 is provided at a position opposite the recording head 38 so as to extend in the sheet width direction. The sheet guide front 34 support the sheet from the bottom side and guide the sheet to the downstream side. With the sheet guide front 34, the spacing between the sheet P and the recording head 38 is regulated.

A sheet discharging device 6 that discharges the sheet P having data recorded thereon is provided on the downstream side of the recording head 38. The sheet discharging device 6 includes a discharge driving roller 39, which is driven by a motor (not shown), and a discharge follower roller 40, which is driven to rotate in contact with the discharge driving roller 39. The sheet P having data recorded thereon by the recording device 4 is discharged by the sheet discharging device 6 to a stacker (not shown) that is provided close to the front side of the apparatus.

The printer 1 has a duplex printing mode. When performing a duplex printing, a sheet having data recorded on a first surface is not discharged outside the apparatus but is returned to the upstream side to be introduced to the reversing unit 7. The reversing unit 7 includes a feed roller 42 and a reversing roller 41, and a curving and reversing path of the sheet P is formed by the reversing roller 41. The sheet P is reversed by the reversing roller 41 while being conveyed by the feed roller 42 so that a second surface opposite the first surface having data recorded thereon opposes the recording head 38. In such a state, in a manner similar to the case of the first surface, the sheet P is conveyed by the transport device 5 in the sub-scanning direction to the downstream side, whereby a recording is performed on the second surface.

The printer 1 has a margin-less printing mode wherein four corners of the sheet P are printed without a margin. When performing a margin-less printing, the sheet P is conveyed by the transport device 5 in the sub-scanning direction until the leading end of the sheet P reaches the sheet discharging device 6 and a recording is performed by the recording head 38 in the course of the conveyance. When the leading end of the sheet P reaches the sheet discharging device 6, the sheet P is conveyed by the transport device 5 and the sheet discharging device 6 and a recording is performed by the recording head 38 in the course of the conveyance. When the rear end of the sheet P is released from the transport device 5, the sheet P is conveyed by the sheet discharging device 6 and a recording is performed by the recording head 38 in the course of the conveyance. In this way, the transport device 5 and the sheet discharging device 6 performs a recording on the sheet P in cooperation with the recording head 38 and therefore the devices 5 and 6 and the recording head 38 constitute the recording device 4.

Next, a driving source of the rear feeding unit 2 will be described with reference to FIG. 2. The rear feeding unit 2 has two drive systems of the feed roller driving mechanism 51 and the hopper driving mechanism 52. The feed roller driving mechanism 51 includes an ASF motor 55 as a driving source, a power transmission and switching unit 53. The motive energy of the ASF motor 55 is selectively transmitted to one of the feed roller 11 of the rear feeding unit 2 and the pickup roller 26 of the front feeding unit 3 via the power transmission and switching unit 53.

The hopper driving mechanism 52 includes an ASF sub-motor 56 as a driving source and a power transmission and switching unit 54. The motive energy of the ASF sub-motor 56 is transmitted to a hopper cam (not shown), which switches the posture of the hopper 16, and a return lever cam (not shown), which pivots the return lever 19, via the power transmission and switching unit 51 in an on and off manner. As described above, the retard roller 18 moves toward and away from the feed roller 11 in an interlocked manner with the posture switching operation of the hopper 16.

Hereinabove, the overall configuration of the printer 1 has been described.

Return Lever Position Switching Control

Figure 4:
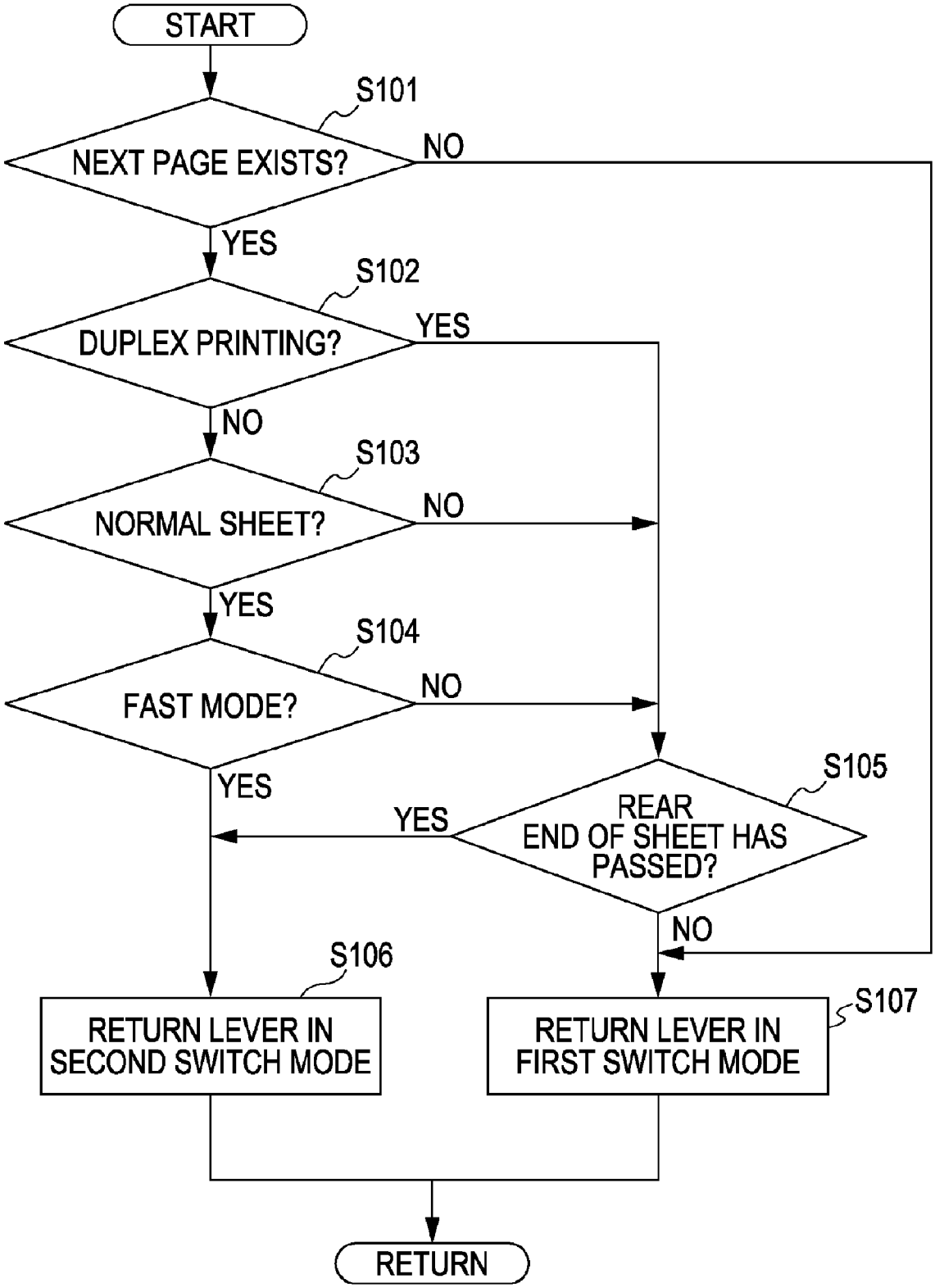
FIG. 4 is a flow chart showing a selection method of a position switching control mode of the return lever.
Figures 5A, 5B:
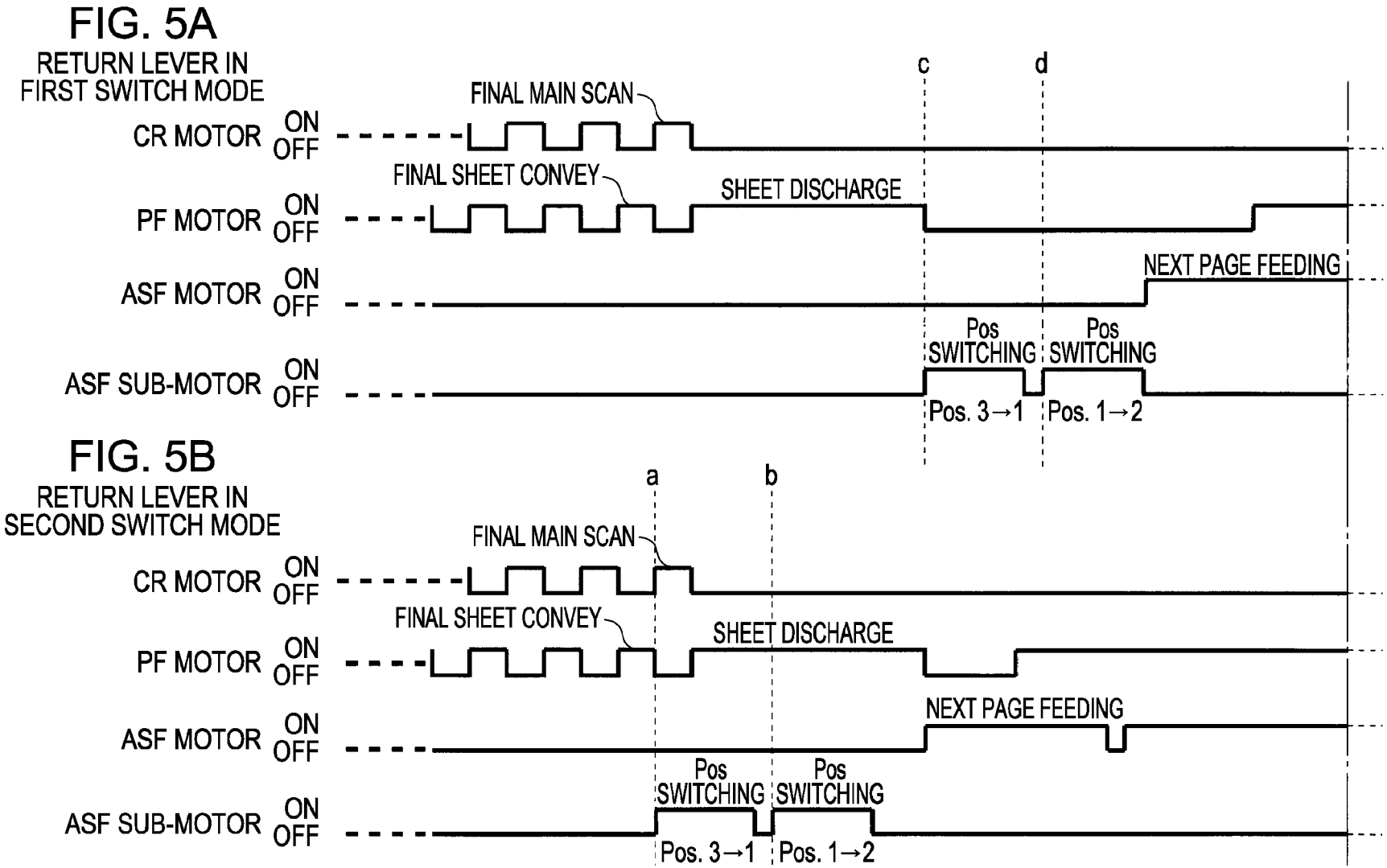
FIGS. 5A and 5B are timing charts showing the operations of the motors in the printer.
Figure 6:
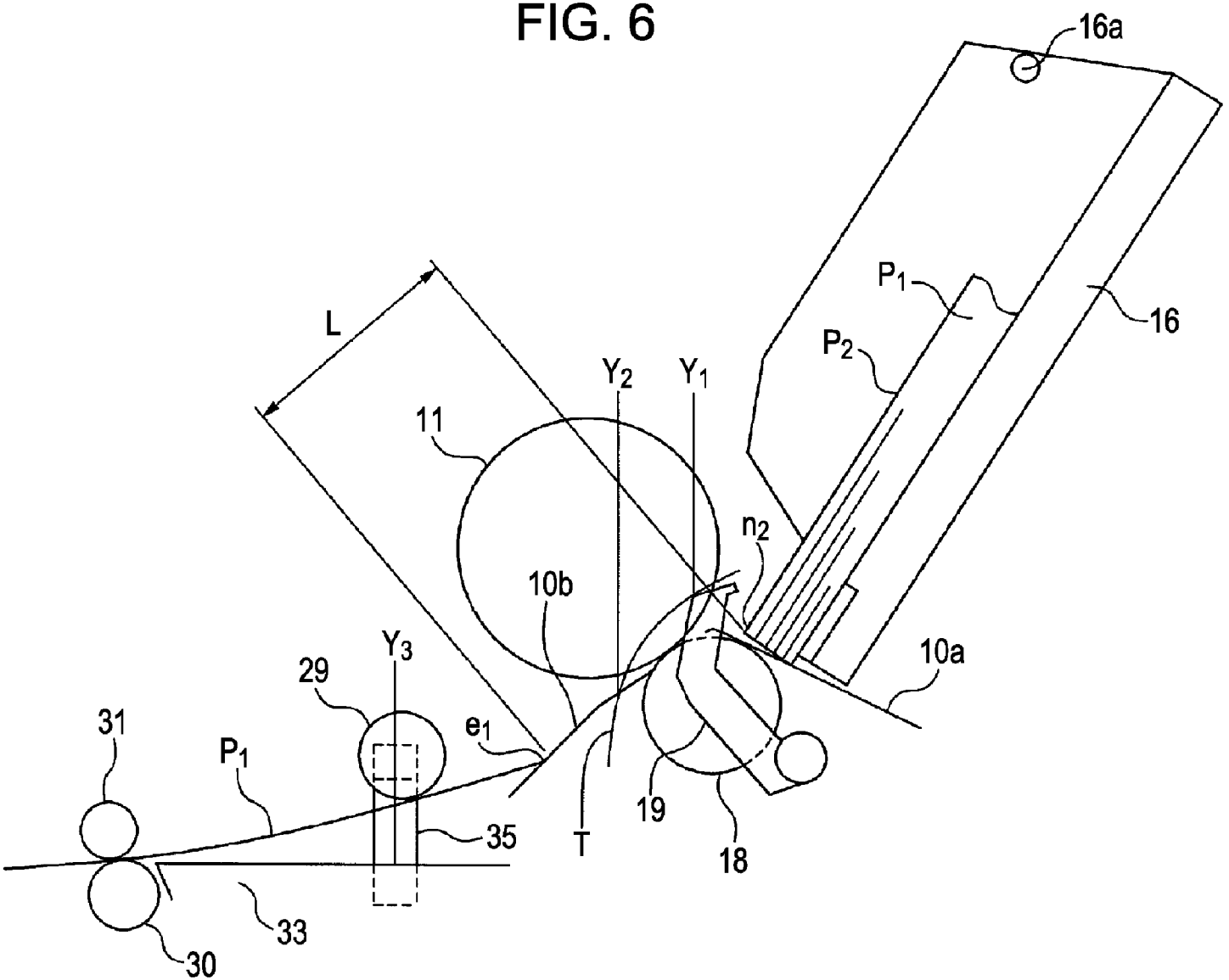
FIG. 6 is a side view of a sheet feeding path.
Figure 7A:
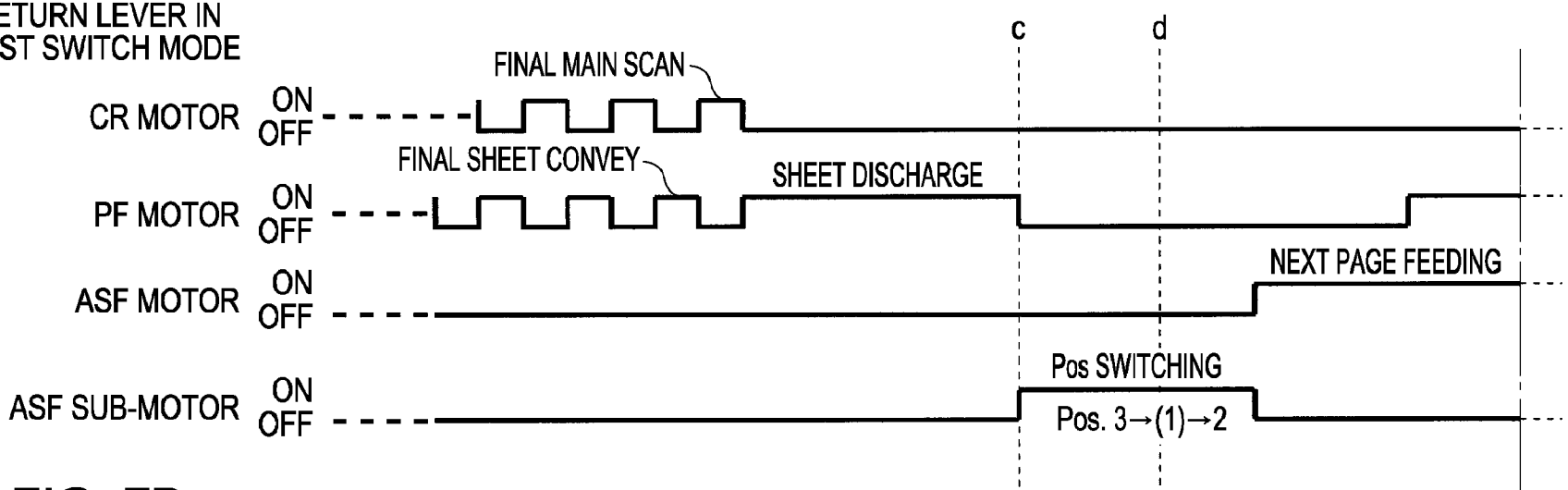
FIGS. 7A and 7B are timing charts showing the operations of the motors in the printer.
Figure 7B:
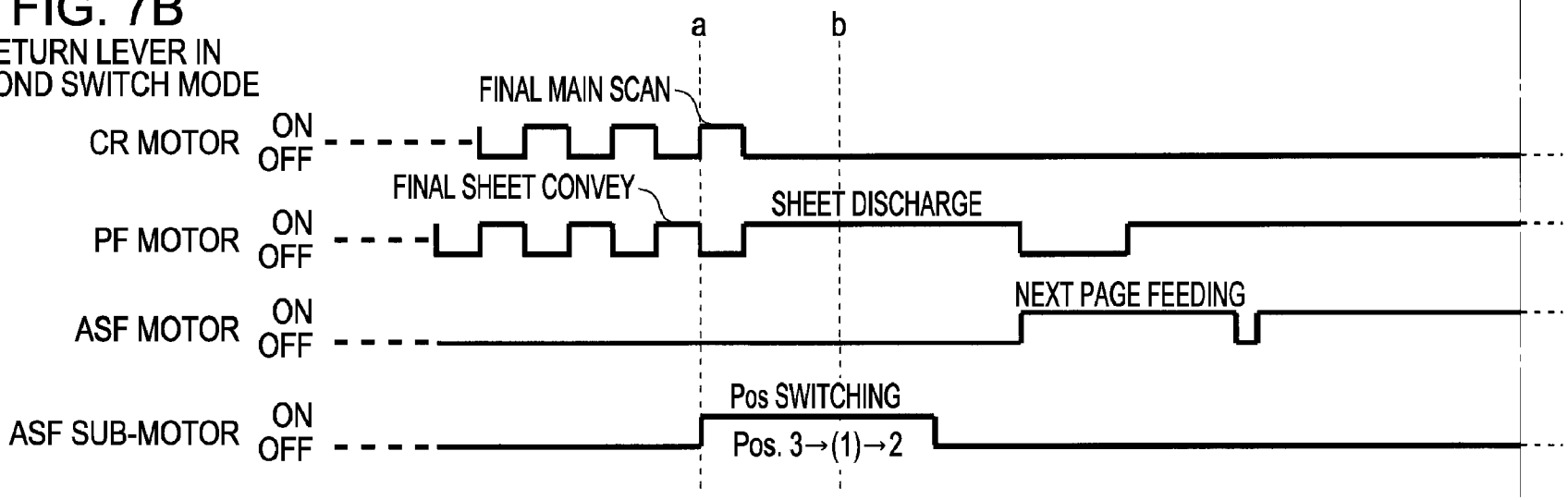

Next, a position switching mode of the return lever 19 will be described with reference to FIGS. 4 to 7. FIG. 4 is a flow chart showing a selection method of a position switching control mode of the return lever 19. FIGS. 5A and 5B are timing charts of the operations of the motors in the printer 1, for showing an embodiment of the operations in the position switching mode of the return lever 19. FIG. 6 is a side view of the sheet feeding path. FIGS. 7A and 7B are timing charts of the operations of the motors in the printer 1, for showing another embodiment of the operations in the position switching mode of the return lever 19.

The control unit 50 has two control modes of first and second switching modes as the position switching mode of the return lever 19. Briefly, the first switching mode is an image-quality priority mode and the second switching mode is a throughput priority mode. In the first switching mode, the return operation of the return lever 19 from the third position to the first position is performed after the discharge operation of the preceding sheet is completed. In the second switching mode, unlike the first switching mode, the return operation is performed in parallel with the operation performed in relation to the preceding page.

When a sheet enters into a state in which the rear end is raised from the bottom side by the return lever 19 in the first position, the degree of curvedness of the sheet increases, increasing a back tension applied thereto, whereby damage such as scratches is caused to the rear surface (second surface). In this respect, in the first switching mode of the image-quality priority mode, the return operation is performed when the discharge operation of the preceding page is completed.

If the sheet is a normal sheet, for example, which has a low rigidity, the back tension does not increase much. Therefore, in the second switching mode of the throughput priority mode, even when a sheet enters into a state in which the rear end is raised from the bottom side by the return lever 19 in the first position, in order to start quickly the sheet feeding operation of the subsequent page, the return operation is performed in parallel with the operation performed in relation to the preceding page without waiting until the discharge operation of the preceding page is completed. With this, it is possible to improve the throughput.

Here, "operation performed in relation to the preceding page" refers to the feeding operation, recording operation, discharge operation or the like of the preceding page. That is, it means all the operations performed in relation to the preceding page after the return lever 19 is completely switched to the third position until the discharge operation of the preceding page is completed. More specifically, the above-mentioned operation includes the operation of the transport device 5 or the sheet discharging device 5 for transporting or discharging the preceding page and the operation of the carriage 36 for performing a recording with the recording head 38.

In the present embodiment, the "recording operation" of the sheet refers to the operation of the recording head 38 from the first main scanning operation to the final main scanning operation. Moreover, the "discharge operation" of the sheet refers to the operation of either one or both of the transport device 5 and the sheet discharging device 6 conveying the sheet P to a predetermined position. The discharge operation does not necessary to involve the complete discharge of the sheet P outside the apparatus. In the present embodiment, however, by way of an example, the discharge operation will be described as being the operation of conveying the sheet P until the rear side is positioned at the downstream side of the sheet discharging device 6; that is, the complete discharge of the sheet P outside the apparatus.

The selection between the two modes of the first and second switching modes is performed based on a condition determination shown in FIG. 4. In the example shown in FIG. 4, this determination is performed, by way of an example, when the final main scanning operation is performed in the recording operation of the preceding page. However, the time of the determination may be appropriately changed.

First, it is determined whether there is a next page to print (Step S101). If there is not a next page to print (Step S101: No), the first switching mode is selected because it is not necessary to prioritize the throughput (Step S107).

Next, it is determined whether a duplex printing is to be performed (Step S102). If the duplex printing is to be performed (Step S102: Yes), the first switching mode is selected so that the return lever 19 does not cause scratches to the rear surface (second surface). However, depending on the position of the rear end of a sheet, a second switching mode can be selected (Step S105: described later).

Next, the sheet type is identified (Step S103). If the sheet is not a normal sheet (Step S103: No), the first switching mode is selected because the sheet may have a high rigidity and therefore a back tension may increase when raised upward by the return lever 19 in the first position. However, depending on the position of the rear end of a sheet, a second switching mode can be selected (Step S105: described later).

Next, it is determined whether a recording mode is a fast mode or not (Step S104). If the recording mode is not the fast mode (Step S104: No), the first switching mode is selected because the image quality is prioritized. However, depending on the position of the rear end of a sheet, a second switching mode can be selected (Step S105: described later).

Subsequently, even when the first switching mode has been selected in Steps S101 to S104, if at that moment, the rear end of the sheet has advanced to a position positioned closer to the downstream side than a position where it comes into contact with the return lever 19, the second mode is selected (Step S105: Yes). This will be described in detail with reference to FIG. 6.

In FIG. 6, the line denoted by a symbol T represents a pivot trajectory drawn by the rear angle portion of the return lever 19 (which is likely to come into contact with the rear surface (second surface) of a sheet). And, the line denoted by a reference numeral 10*b* represents a guide surface of a frame 10 that constitute a body of the rear feeding unit 2, by which the leading end of the sheet P is guided to the downstream side. The line denoted by a reference numeral 10*a* represents a leading end supporting surface that supports the leading end of the sheet P stacked on a hopper. The return lever 19 shown in FIG. 6 is in the first position and the line denoted by Y1 represents the position of the rear angle portion of the return lever 19 at that moment.

If the rear end (denoted by a reference numeral e1) of a previously fed sheet (a preceding page, denoted by a reference numeral P1) is positioned closer to the downstream side than the position Y1, even when the return lever 19 performs the return operation from the third position to the first position, the rear end of the preceding sheet P1 is not raised from the bottom side by the return lever 19.

Therefore, if the rear end e1 of the preceding sheet P1 is positioned closer to the downstream side than the position Y1, even when the return lever 19 is switched to the first position from the third position, the sheet P1 is not raised by the return lever 19. Therefore, it is possible to prevent any increase in the back tension and generation of scratches on the rear surface (second surface) of the sheet. In such a case, the second switching mode is selected to improve the throughput.

As seen from a side of the sheet feeding path, the upstream side of a position Y2 intersecting the guide surface 10*b* and the pivot trajectory T is an area where the rear end of the sheet is likely to come into contact with the return lever 19. In this respect, in Step S105 of FIG. 4, it may be determined whether the rear end of the preceding sheet P1 has passed the position Y2.

The position of the rear end e1 of the preceding sheet P1 can be identified by information such as the amount of rotation of the feed roller 11 after the leading end of the sheet P1 has passed the sheet sensor 35 (position Y3) or the size (length) of the sheet P1 as identified by a printer driver. If the size of the sheet designated on the printer driver differs from the actual size of the sheet, it may be difficult to identify the exact position of the rear end e1 of the preceding sheet P1. In this respect, in Step S105 of FIG. 4, it may be determined whether the rear end e1 of the preceding sheet P1 has passed (or is detected by) the sheet sensor 35.

As described above, in the first switching mode, the return operation of the return lever 19 from the third position to the first position is performed after the discharge operation of the sheet is complete (in FIG. 5A, the position denoted by "c"). Therefore, in the first switching mode, the rear end ("e1" in FIG. 6) of the preceding page does not come into contact with the return lever 19 and the back tension is reduced and thus preventing generation of scratches in the rear surface of the sheet. The position "d" in FIG. 5A represents the time at which the feeding operation of the subsequent page is started in the first switching mode, wherein the feeding operations is started by the switching operation of the return lever 19 from the first position to the second position.

Next, in the second switching mode, the return operation is started when the final main scanning operation of the recording operation on the preceding page is started (in FIG. 5B, the position denoted by "a"). With this, the return operation is performed in parallel with the recording operation on the preceding page and the discharge operation. Therefore, the feeding operation of the subsequent page can be started immediately after the return operation is complete (in FIG. 5B, the position denoted by "b"). Accordingly, it is possible to improve the throughput.

The switching mode is selected from the two modes depending on the type of the sheet, a recording mode, or whether a duplex printing will be performed or not. Therefore, it is possible to obtain a recording result (recording quality or throughput) that is most suitable for a recording condition such as the type of the sheet, a recording mode, or whether a duplex printing will be performed or not.

According to the example described above, in the second switching mode, the return operation is started when the final main scanning operation of the recording operation on the preceding page is started (in FIG. 5B, the position denoted by "a"). However, the invention is not limited to this. If a partial or entire portion of the return operations can be performed in parallel with the operations performed in relation with the preceding page, the feeding operation of the subsequent page may be immediately without needing to wait until the return operation is completed, thereby improving the throughput. For example, after the return operation from the second position to the third position is performed, the return operation from the third position to the first position may be performed immediately. Moreover, the return operation may be performed immediately after the first main scanning operation is started.

In particular, by setting the start time of the return operation so that the return operation is completed at least before the discharge operation of the preceding page is completed or more preferably before the recording operation on the preceding page is completed, it is possible to start the feeding operation of the subsequent page immediately without needing to wait until the operation of the return lever 19 is completed.

In this respect, as another embodiment, the start time of the return operation may be set such that the return operation is completed before the feeding operation of the subsequent page becomes ready to start.

Here, as a condition wherein the feeding operation of the subsequent page becomes ready to start, a case as shown in FIG. 6 can be exemplified in which the rear end e1 of the preceding page has advanced to a position positioned closer to the downstream side than the nip point between the feed roller 11 and the retard roller 18 and the spacing between the rear end e1 and the leading end n2 of the subsequent page approaches close to a predetermined secure spacing L. Until the above-mentioned condition is satisfied, if the return operation is completed, the feeding operation of the subsequent page can be performed immediately without needing to wait until the return operation is completed. The condition wherein the feeding operation of the subsequent page becomes ready to start is only for illustration. Such a condition differs depending on the configuration of the apparatus, and therefore, needless to say, the invention is not limited to this.

In the embodiment described above, the return lever 19 has three operation modes, as its operation mode; that is, an operation mode from the first position to the second position, an operation mode from the second position to the third position, and an operation mode from the second position to the first position, and the position of the return lever 19 is controlled by performing the respective operation modes. By further including an operation mode from the third position to the second position, it is possible to improve the throughput much more.

In FIGS. 5A and 5B, in order for the return lever 19 to switch from the third position to the second position, after an operation of "Pos. 3–>1" is performed, the ASF sub-motor is temporarily stopped and then an operation of "Pos. 1–>2" is performed. However, as shown in FIGS. 7A and 7B, such a operation can be performed at once by an operation of "Pos. 3–>(1)–>2," wherein without needing to stop the ASF sub-motor, the return lever 19 can be switched from the third position directly to the second position. By doing this, it is possible to improve the throughput much more.

What is claimed is:

1. A recording apparatus, comprising:

a recording medium setting portion on which plural recording media are set in a stacked state;

a feed roller that feeds a recording medium set on the recording medium setting portion in a feeding direction;

a recording medium return lever that returns a recording medium next or subsequent to a recording medium continuously fed out from the recording medium setting portion along with the recording medium to be fed;

a control unit that controls the recording medium return lever; and a recording unit that performs recording on the recording medium, wherein the control unit controls the recording medium return lever so that the position is switched from a first position, a second position and to a third position:

in the first position, the recording medium return lever is in a feeding waiting state and closes the sheet feeding path;

in the second position, a leading end of the recording medium return lever is positioned at a position positioned closer to a downstream side than the first position; and in the third position, the leading end is positioned at a position positioned closer to an upstream side than the first position, and wherein the control unit has a control mode in which when a feeding operation of a subsequent page is about to start, a partial or entire portion of a return operation of the recording medium return lever from the third position to the first position is performed in parallel with an operation performed in relation with a preceding page.

2. A recording apparatus, comprising:

a recording medium setting portion on which a plural recording media are set in a stacked state;

a feed roller that feeds a recording medium set on the recording medium setting portion in a feeding direction;

a recording medium return lever that returns a recording medium next or subsequent to a recording medium continuously fed out from the recording medium setting portion along with the recording medium to be fed;

a control unit that controls the recording medium return lever; and a recording unit that performs recording on the recording medium, wherein the control unit controls the recording medium return lever so that the position is switched from a first position, a second position and to a third position:

in the first position, the recording medium return lever is in a feeding waiting state and closes the sheet feeding path;

in the second position, a leading end of the recording medium return lever is positioned at a position positioned closer to a downstream side than the first position; and in the third position, the leading end is positioned at a position positioned closer to an upstream side than the first position, and wherein the control unit has a control mode in which when a feeding operation of a subsequent page is about to start, a return operation of the recording medium return lever from the third position to the first position is completed before the feeding operation of the subsequent page becomes ready to start.

3. The recording apparatus according to claim 1, wherein in the control mode, the control unit starts the return operation of the recording medium return lever from the third position to the first position after the final sub-scanning conveying for recording on a preceding page is completed.

4. The recording apparatus according to claim 3, wherein depending on the type of the recording medium, the control unit starts the return operation of the recording medium return lever from the third position to the first position when the rear end of the recording medium has advanced to a position positioned closer to the downstream side than a position where the rear end comes into the recording medium return lever.

5. The recording apparatus according to claim 3, further comprising a reversing unit that reverses the recording medium having data recorded thereon, wherein when a duplex recording is performed on the recording medium and when the return operation of the recording medium return lever from the third position to the first position is performed before a recording is performed on the second surface of the recording medium, the control unit starts the return operation when the rear end of the recording medium has advanced to a position positioned closer to the downstream side than a position where the rear end comes into contact with the recording medium return lever.

6. The recording apparatus according to claim 3, wherein depending on a recording mode in which a recording is performed on the recording medium, the control unit starts the return operation of the recording medium return lever from the third position to the first position when the rear end of the recording medium has advanced to a position positioned closer to the downstream side than a position where the rear end comes into the recording medium return lever.

7. The recording apparatus according to claim 2, wherein in the control mode, the control unit starts the return operation of the recording medium return lever from the third position to the first position after the final sub-scanning conveying for recording on a preceding page is completed.

8. The recording apparatus according to claim 7, wherein depending on the type of the recording medium, the control unit starts the return operation of the recording medium return lever from the third position to the first position when the rear end of the recording medium has advanced to a position positioned closer to the downstream side than a position where the rear end comes into the recording medium return lever.

9. The recording apparatus according to claim 7, further comprising a reversing unit that reverses the recording medium having data recorded thereon, wherein when a duplex recording is performed on the recording medium and when the return operation of the recording medium return lever from the third position to the first position is performed before a recording is performed on the second surface of the recording medium, the control unit starts the return operation when the rear end of the recording medium has advanced to a position positioned closer to the downstream side than a position where the rear end comes into contact with the recording medium return lever.

10. The recording apparatus according to claim 7, wherein depending on a recording mode in which a recording is performed on the recording medium, the control unit starts the return operation of the recording medium return lever from the third position to the first position when the rear end of the recording medium has advanced to a position positioned closer to the downstream side than a position where the rear end comes into the recording medium return lever.

* * * * *